US006623536B1

(12) United States Patent
Eydoux et al.

(10) Patent No.: US 6,623,536 B1
(45) Date of Patent: Sep. 23, 2003

(54) MULTIFUNCTIONAL ADDITIVE COMPOSITION FOR COLD PROCESS TREATMENT OF MIDDLE DISTILLATES

(75) Inventors: Franck Eydoux, Saint Laurent d'Agry (FR); Robert Leger, Taluyere (FR)

(73) Assignee: Elf Antar France, Puteaux (FR)

( * ) Notice: Subject to any disclaimer, the term of this patent is extended or adjusted under 35 U.S.C. 154(b) by 0 days.

(21) Appl. No.: 09/958,718

(22) PCT Filed: Apr. 12, 2000

(86) PCT No.: PCT/FR00/01052

§ 371 (c)(1),
(2), (4) Date: Mar. 25, 2002

(87) PCT Pub. No.: WO00/65000

PCT Pub. Date: Nov. 2, 2000

(30) Foreign Application Priority Data

Apr. 26, 1999 (FR) ..... 99 05235

(51) Int. Cl.[7] ..... C10L 1/18; C10L 1/22

(52) U.S. Cl. ..... 44/331; 44/347; 44/393; 44/394; 44/419

(58) Field of Search ..... 44/331, 347, 393, 44/394, 419

(56) References Cited

U.S. PATENT DOCUMENTS 5,725,610 A * 3/1998 Vassilakis et al. ..... 44/331
5,755,834 A * 5/1998 Chandler ..... 44/386
5,766,273 A * 6/1998 Dralle-Voss et al. ..... 44/346
6,086,645 A * 7/2000 Quigley et al. ..... 44/418

FOREIGN PATENT DOCUMENTS

WO WO95/09220 4/1995

* cited by examiner

*Primary Examiner*—Cephia D. Toomer
(74) *Attorney, Agent, or Firm*—Townsend and Townsend and Crew LLP

(57) ABSTRACT

The invention concerns a composition of mulifunctional additives for cold process treatment obtained by reacting carboxylic compounds with amine compounds, characterized in that it contains at least 50 wt. % of a mixture consisting of 10 to 90 wt. % of an additive (AB) of a carboxylic compound (A) selected among maleic and succinic anhydrides, corresponding acids and esters with a polyalkylamine (B) and 90 to 10 wt. % of an additive (CD) obtained by reacting a copolymer (C) obtained by reacting a first unsaturated carboxylic acid with an alkylated ester of a second unsaturated carboxylic acid, identical to or different from the first, of general formula (II) $R_1R_2C{=}CR_3COOR_4$ wherein $R_1$ and $R_2$, identical or different, being hydrogen, a linear or branched $C_1$–$C_{20}$ alkyl radical; $R_3$ is hydrogen or a linear or branched alkyl group with not more than three carbon atoms and $R_4$ is hydrogen or a $C_1$–$C_{25}$ radical, with N-alkylpolyalkylenepolyamine (D).

28 Claims, No Drawings

MULTIFUNCTIONAL ADDITIVE COMPOSITION FOR COLD PROCESS TREATMENT OF MIDDLE DISTILLATES

The present invention relates to a novel multi-functional additive composition which improves the cold operability of middle distillates, in particular in the course of the processes of slow cooling during the storage of fuels and combustibles at low temperatures. The invention is directed in particular toward improving the antisedimentation properties for an application in fuels for diesel engines and in combustibles such as domestic fuel oils for boilers.

Cold operability corresponds to a limit temperature at which the middle distillates may be used without any problems of clogging. It is intermediate between the cloud point (ASTM D 2500-66), characteristic of the start of crystallization of paraffins in the distillate, and the pour point of this distillate (ASTM D 97-66).

It is well known that the crystallization of paraffins is a limiting factor in the use of middle distillates. Thus, it is important to prepare diesel fuels that are suitable for the temperatures at which they will be used in motor vehicles, that is to say for the surrounding climate. Generally, a cold operability for fuels of −10° C. is sufficient in many industrialized countries. However, in other countries such as the Scandinavian countries, Canada and the countries of north Asia, fuel working temperatures of well below −20° C. can be expected. This is likewise the case for domestic fuel oils stored outside for private houses and buildings.

This suitability of the cold operability of diesel fuels is important, especially when the engines are being started cold. If paraffins are crystallized at the bottom of the tank, they can be drawn into the engine on starting and can block in particular the filters and prefilters arranged before the injection systems (pump and injectors). Similarly, in the case of the storage of domestic fuel oils, paraffins precipitate at the bottom of the tank and can be drawn in and obstruct the pipes before the pump and the boiler feed system (injection nozzle and filter). Obviously, the presence of solids, such as paraffin crystals, prevents the normal circulation of the middle distillate.

To improve their circulation either in an engine or toward boilers, several types of additives have come to light.

In a first stage, the oil industry concentrated on the development of additives which promote the filterability of fuels at low temperature. The role of these additives, known as cold filter-plugging point (CFPP) additives, is to limit the size of the paraffin crystals formed. Additives of this type, which are widely known to those skilled in the art, are currently systematically added to middle distillates.

However, these additives, although controlling the size of the paraffin crystals, cannot prevent the sedimentation of the crystals formed, that is to say their agglomeration, especially at the bottom of the fuel tanks of diesel vehicles when stationary or in storage tanks for domestic fuel oils.

Thus, in a second stage, the oil industry made efforts to develop antisedimentation additives, that is to say dispersants, which keep the paraffin crystals in suspension in the middle distillate, thus preventing them from depositing and agglomerating together. The Applicant has especially developed such an additive described in patent EP 0 674 689.

Nevertheless, the joint action of CFPP and antisedimentation additives has not made it possible to improve the cold operability of all the middle distillates produced in refining in the case of all the known crude oils.

This is why the oil industry has introduced a third type of additive with a view to lowering the cold operability temperature of middle distillates, whatever they be, beyond −20° C., even if their cloud point is above −20° C. This is the case for the additives described in patents EP 0 722 481 and EP 0 832 172. However, this set of additives shows good operability properties depending on the cold regimes when compared with measures which have been taken by cold immersion, according to NF standard M 07 085, of fuels and combustibles containing such additives. However, although this method makes it possible to judge the efficacy of the additives, it is not rigorously representative of the actual cooling phenomena of fuels and combustibles. Thus, the amplitude and speed of cooling are variable depending on the region, and thus depending on the ambient temperature of the vehicles. A slow cooling is very favorable toward gradual sedimentation of paraffins, and thus it is necessary to find solutions to prevent this phenomenon.

The present invention is directed toward a multifunctional additive composition for lowering and maintaining the cold operability temperature of middle distillates, so that during a step of slow cooling on storage in a closed container, down to temperatures beyond −20° C., no sedimentation of the paraffins contained in the middle distillates is observed.

One subject of the present increase is thus a multifunctional additive composition for the cold operability of middle distillates resulting from the reaction of carboxylic compounds with amine compounds, characterized in that it contains at least 50% by weight of a mixture consisting of:

a) 10% to 90% by weight of an additive (AB) resulting from the reaction of at least one carboxylic compound (A) chosen from alkylmaleic and alkenylmaleic anhydrides and alkylsuccinic and alkenylsuccinic anhydrides containing from 4 to 32 carbon atoms in the alkyl and alkenyl radicals, the corresponding acids and esters with at least one polyalkyleneamine (B) of general formula (I) below:

$$NH_2—[(CH_2)_n—NH—]_m—H \quad (I)$$

in which n is an integer ranging from 2 to 4 and m is an integer ranging from 1 to 4, the molar ratio A/B being between $$\frac{1}{m+1}$$

and m+1, and preferably between 1 and 2, b) and 90% to 10% by weight of an additive (CD) resulting from the reaction:

i) of at least one copolymer (C) resulting from the reaction of at least one first unsaturated carboxylic acid which may be unsubstituted or substituted with at least one alkyl ester of at least one second substituted or unsubstituted unsaturated carboxylic acid, which may be identical to or different from the first, of general formula (II) below:

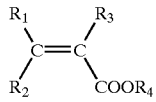

(II)

in which $R_1$ and $R_2$, which may be identical or different, are chosen from the group consisting of hydrogen and linear or branched alkyl groups containing from 1 to 20 carbon atoms, $R_3$ is hydrogen or a linear alkyl group of not more than 3 carbon atoms and $R_4$ is hydrogen or an alkyl group containing from 1 to 25 carbon atoms, ii) with an N-alkylpolyalkylenepolyamine (D) of general formula (III) below:

$$R_5—NH—[—(CH_2)_p—NH—]_q—H \quad (III)$$

in which $R_5$ is a saturated aliphatic radical comprising from 1 to 32 carbon atoms, p is an integer ranging between 2 and 4 and q is an integer ranging between 1 and 4, the molar ratio C/D ranging between $$\frac{1}{q+1}$$

and q+1, and preferably ranging between 1 and 2.

The combination of these two reaction products (AB) and (CD) in the composition according to the invention has made it possible to very significantly improve the cold operability of fuels and combustibles into which they are incorporated for a slow cooling, when compared with the efficacy of these products taken separately.

To compare the efficacy of this additive composition with the additives known in the prior art, the Applicant developed a new test based on NFT standard M 07 085 in which the procedure of rapid cooling by immersion has been replaced with a slow and controlled cooling of the temperature, for example by 1 to 3 degrees per minute, down to a nominal temperature, for example −20° C.

More specifically, the additive according to the invention consists of:

50% to 100% by weight of the combination containing from 20% to 80% by weight of the additive AB and from 80% to 20% by weight of the additive CD, and 0% to 50% by weight of a combination of the additives AD and CB obtained by reacting A and D in a molar ratio ranging between 0.2 and 4, and of B with C in a molar ratio ranging between 0.2 and 4, A, B, C and D having been defined beforehand for the multifunctional additives AB and CD.

In a first embodiment, the additive composition is obtained by combination of 50% to 80% of AB and 20% to 50% by weight of the reaction product CD.

In a second embodiment, the additive composition comprises from 50% to 80% by weight of a combination AB,CD in an AB/CD molar ratio ranging from 0.2 to 4, and from 20% to 50% by weight of a mixture of AD,CB in 20 an AD/CB molar ratio ranging from 0.2 to 4.

The carboxylic compound (A) is preferably chosen from the group comprising dodecylmaleic anhydride, dodecenylmaleic anhydride, hexadecylmaleic anhydride, hexadecenylmaleic anhydride, octadecylmaleic anhydride, octadecenylmaleic anhydride, eicosylmaleic anhydride and eicosenylmaleic anhydride.

The polyalkyleneamine (B) is preferably chosen from the group comprising diethylenetriamine, dipropylenetriamine, triethylenetetramine, tripropylenetetramine, tetraethylenepentamine and tetrapropylenepentamine.

The copolymer (C) is preferably a copolymer containing from 45 mol % to 65 mol % of at least one carboxylic acid unit and from 55 mol % to 35 mol % of at least one alkyl ester unit. The carboxylic acid units are preferably chosen from units resulting from acrylic acid and methacrylic acid, and the alkyl ester units are preferably chosen from units resulting from acrylic esters and methacrylic esters, and derivatives thereof. In a more favorable mode, the copolymer (C) is chosen from acrylic acid/methacrylic ester copolymers and methacrylic acid/acrylic ester copolymers containing 45 mol % to 65 mol % of acid units and from 55 mol % to 35 mol % of ester units.

The N-alkylpolyalkylenepolyamine (D) is preferably chosen from the group comprising N-alkylethylenediamines, N-alkylpropylenediamines, N-alkylbutylenediamines, N-alkyldiethylenetriamines, N-alkyldi-propylenetriamines, N-alkyldibutylenetriamines, N-alkyltriethylenetetramines, N-alkyltripropylene-tetramines and N-alkyltributylenetetramines with an alkyl radical containing from 12 to 22 carbon atoms. Preferably, D is chosen from N-dodecyldipropylenetriamine, N-octadecyldipropylenetriamine, N-octadecyldiethylenetriamine and N-docosyldiethylenetriamine.

A second subject of the invention is a fuel containing a majority of middle distillate generally containing a filterability additive, and a minority, for example from 50 to 1000 ppm, of a multifunctional additive composition for cold operability for slow cooling.

It would not constitute a departure from the context of the invention if proketane additives, detergents, additives with a pour point and a cloud point, antifoam additives, demulcents, anticorrosion additives and antioxidants were added to this fuel.

Non-limiting examples are given for the purposes of illustrating the advantages of the present invention.

EXAMPLE 1

The present example shows the two cooling methods used and also the composition of the gas oils and additives tested. The method of cooling by immersion described in NFT standard M 07-085 consists in pouring a sample of distillate into a measuring cylinder and in placing it for 24 hours in a refrigerated cupboard at a temperature generally set between −13 and −20° C., that is to say at a temperature at least 1° C. below its cloud point, and at least 6° C. above its pour point.

After 24 hours, the appearance of the distillate (cloudy, slightly cloudy, clear and transparent) and the volume of paraffin crystals settled in the bottom of the measuring cylinder are observed.

If the upper phase has remained cloudy, the paraffin crystals have remained in suspension and the antisedimentation function of the additive compositions is thus effective. If the upper phase is clear and a cloudy blanket appears at the bottom of the cylinder, there is considerable sedimentation and the antisedimentation function of the additive composition is ineffective.

For a more quantitative approach of the sedimentation, equal volumes are taken from the top and bottom of the measuring cylinder to determine the crystallization starting temperature (CST), determined by the DCA (differential calorimetric analysis) method and the cold filter-plugging point (CFPP). The results are compared with the initial values previously measured, a minimum temperature difference indicating a maximum homogeneity and thus a maximum dispersing action of the additive composition.

The method of slow cooling consists in introducing the gas oil sample, containing or not containing additives, into a measuring cylinder, in placing it in a refrigerated cupboard at a temperature 10° C. above the cloud point of said gas oil. The sample is gradually cooled from this temperature by 1 to 3° C./hour down to a final test temperature which may be as low as −15 to −20° C. Once the final temperature has been reached, the sample is maintained for 24 hours at this temperature and the visual grading already mentioned for the fast immersion method is then carried out, and also samples of the phases are taken at the top and bottom of the measuring cylinder to determine the CST and CFPP of these different phases. The interpretation of the results is identical to that of the fast immersion method. Three gas oils, $G_1$, $G_2$ and $G_3$, were tested: their characteristics are given before and after doping with a filterability additive of ethylene/vinyl acetate copolymer type in Table I below:

TABLE I

| ANALYSES | $G_1$ | $G_2$ | $G_3$ |
|---|---|---|---|
| Cloud point in ° C. | −3 | −7 | −6 |
| Cold filter-plugging point, in ° C. | −3 | −7 | −7 |
| Pour point in ° C. | −15 | −12 | −12 |
| Crystallization start temperature, in ° C. | −5.63 | −8.97 | −9.86 |
| Percentage of paraffin | 11.5 | 14.8 | 11.4 |
| % of paraffin < C13 | 0.9 | 1.7 | 1.2 |
| % C13–17 | 8.7 | 10.0 | 8.4 |
| % C18–23 | 1.9 | 3.1 | 1.8 |
| % C24–24+ | 0 | 0 | 0 |
| Distillation: start point | 176 | 162 | 176 |
| Point at 5% by volume | 199 | 185 | 200 |
| Point at 10% by volume | 208 | 194 | 213 |
| Point at 20% by volume | 222 | 212 | 230 |
| Point at 30% by volume | 238 | 230 | 243 |
| Point at 40% by volume | 252 | 246 | 256 |
| Point at 50% by volume | 264 | 260 | 269 |
| Point at 60% by volume | 277 | 274 | 282 |
| Point at 70% by volume | 291 | 287 | 296 |
| Point at 80% by volume | 310 | 304 | 314 |
| Point at 90% by volume | 338 | 325 | 338 |
| Point at 95% by volume | 361 | 340 | 356 |
| Final point | 371 | 354 | 362 |
| Mass per unit volume at 15° C., in kg/l | 0.8372 | 0.8352 | 0.8413 |
| Flash point, in ° C. | 70 | 65 | 69 |
| Ketane number | 50.9 | 48.9 | 60.5 |
| Gi + CFPP (ppm) | 250 | 250 | 125 |
| Cold filter-plugging point, in ° C. | −17 | −16 | −18 |
| Pour point, in ° C. | −27 | −24 | −24 |

The additives according to the invention $X_1$ to $X_6$ are described in Table II below: the values correspond to the percentages by mass of each of the compounds AD, BC, CD and AB introduced into the formulations $X_1$.

TABLE II

| ADDITIVE | AD | AB | CD | CB |
|---|---|---|---|---|
| Molar ratio | 2 | 2 | 2 | 2 |
| $X_1$ | | 50 | 50 | |
| $X_2$ | 40 | 10 | 10 | 40 |
| $X_3$ | 25 | 25 | 25 | 25 |
| $X_4$ | | 80 | 20 | |
| $X_5$ | | 20 | 80 | |
| $X_6$ | 25 | 25 | 25 | 25 |

with:

A=octadecylmaleic anhydride

B=diethylenetriamine

C=acrylic acid/methacrylate copolymer (60 mol % of acid units, 20 mol % of lauryl methacrylate units and 20 mol % of stearyl methacrylate units)

D=N-dodecyldipropylenetriamine

These samples $X_1$ are introduced at a content of 200 ppm into the gas oils $G_1$ and $G_2$, and at 100 ppm into the gas oil $G_3$.

EXAMPLE II

The present example is directed toward showing the difference between the method of cooling by immersion and the method of slow cooling at 1° C. per hour, and thus the value of selecting additives which reproduce the actual cooling phenomenon of a car fuel tank when stationary and thus of the cooling process of gas oil.

The results of these tests using cooling procedures described in Example I are given in Table III below. The efficacy of these additives is assessed by calculating the sum of the differences between, on the one hand, the cold filter-plugging point (CFPP), before the sedimentation test, and that of the sample taken from the bottom of the measuring cylinder after the sedimentation test, and, on the other hand, the sum of the differences between the crystallization start temperatures (CST) for the samples taken from the top and bottom of the measuring cylinder after the sedimentation test.

The composition of multifunctional additives is proportionately more effective the lower the sum of the six differences on the three gas oils.

TABLE III

| | Conventional method NFT M 07-085 | | | | | | | |
|---|---|---|---|---|---|---|---|---|
| | $G_1$ | | $G_2$ | | $G_3$ | | Sum of the | |
| | CST diff. | CFPP diff. | CST diff. | CFPP diff. | CST diff. | CFPP diff. | differences in ° C. | Grading |
| Gi + CFPP | 21.2 | 11 | 17.8 | 10 | 19.7 | 10 | 89.7 | 11 |
| AD | 2.1 | 0 | 3.9 | 3 | 9.4 | 1 | 19.4 | 1st |
| AB | 6.2 | 4 | 15.8 | 11 | 12.0 | 2 | 51 | 4 |
| CD | 2.2 | 6 | 7.2 | 3 | 12.7 | 4 | 35.1 | 2 |
| CB | 16.1 | 6 | 17.0 | 9 | 19.2 | 11 | 78.3 | 10 |
| $X_1$ | 5.0 | 0 | 15.5 | 6 | 17.3 | 9 | 52.8 | 5 |
| $X_2$ | 4.6 | 0 | 14.3 | 7 | 17.1 | 10 | 53 | 6 |
| $X_3$ | 8.2 | 2 | 16.3 | 9 | 16.2 | 8 | 59.7 | 8 |
| $X_4$ | 9.6 | 3 | 17.0 | 11 | 13.7 | 4 | 58.3 | 7 |
| $X_5$ | 10.5 | 3 | 12.3 | 5 | 12.0 | 5 | 47.8 | 3 |
| $X_6$ | 11.4 | 3 | 16.0 | 9 | 18.5 | 9 | 66.9 | 9 |

| | Slow method 1° C./hour | | | | | | | |
|---|---|---|---|---|---|---|---|---|
| | $G_1$ | | $G_2$ | | $G_3$ | | Sum of the | |
| | CST diff. | CFPP diff. | CST diff. | CFPP diff. | CST diff. | CFPP diff. | differences in ° C. | Grading |
| Gi + CFPP | 25.1 | 14 | 21.8 | 13 | 22.5 | 14 | 110.4 | 11 |
| AD | 19.1 | 15 | 20.3 | 14 | 21.9 | 14 | 104.3 | 8 |
| AB | 21.8 | 15 | 20.6 | 16 | 20.5 | 14 | 107.9 | 9 |
| CD | 22.1 | 15 | 20.2 | 15 | 20.3 | 11 | 103.6 | 7 |
| CB | 22.3 | 13 | 21.7 | 14 | 22.3 | 15 | 108.3 | 10 |
| $X_1$ | 15.4 | 9 | 18.0 | 11 | 9 | 1 | 63.4 | 1st |
| $X_2$ | 20.4 | 13 | 20.1 | 16 | 17.1 | 10 | 96.9 | 5 |
| $X_3$ | 21.2 | 12 | 20.3 | 16 | 14.8 | 6 | 90.3 | 3 |
| $X_4$ | 22.1 | 16 | 20.5 | 17 | 13.1 | 7 | 95.7 | 4 |
| $X_5$ | 21.1 | 13 | 20.4 | 15 | 12.5 | 6 | 88 | 2 |
| $X_6$ | 21.2 | 19 | 20.8 | 16 | 16.9 | 9 | 102.9 | 6 |

It is seen from this table that the grading of the additives is appreciably modified when the mode of cooling varies. Specifically, the formulae $X_1$ are more effective than the reaction products AD, AB, CD and CB when subjected to a slow cooling of 1° C. per hour.

What is claimed is:

1. A multifunctional additive composition for the cold operability of middle distillates resulting from the reaction of carboxylic compounds with amine compounds, characterized in that it contains at least 50% by weight of a mixture consisting of:

a) 10% to 90% by weight of an additive (AB) which is the reaction product of at least one carboxylic compound (A) selected from the group consisting of alkylmaleic and alkenylmaleic anhydrides and alkylsuccinic and alkenylsuccinic anhydrides containing from 4 to 32 carbon atoms in the alkyl and alkenyl radicals, the corresponding acids and esters with at least one polyalkylamine compound (B) of the formula (I):

$$NH_2—[(CH_2)_n—NH—]_m—H \quad (I)$$

in which n is an integer ranging from 2 to 4 and m is an integer ranging from 1 to 4, the molar ratio A/B being between $$\frac{1}{m+1}$$

and m+1, and b) 90% to 10% by weight of an additive (CD) which is the reaction product of:

i) of at least one copolymer (C) resulting from the reaction of at least one first unsaturated carboxylic acid which may be unsubstituted or substituted with at least one alkyl ester of at least one second substituted or unsubstituted unsaturated carboxylic acid, which may be identical to or different from the first, of the formula (II):

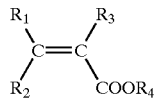

(II)

in which $R_1$ and $R_2$, which may be identical or different, are selected from the group consisting of hydrogen and linear or branched alkyl groups containing from 1 to 20 carbon atoms, $R_3$ is hydrogen or a linear alkyl group of not more than 3 carbon atoms and $R_4$ is hydrogen or an alkyl group containing from 1 to 25 carbon atoms, ii) with an N-alkylpolyalkylenepolyamine (D) of the formula (III):

$$R_5—NH—[—(CH_2)_p—NH—]_q—H \quad (III)$$

in which $R_5$ is a saturated aliphatic radical comprising from 12 to 22 carbon atoms, p is an integer ranging between 2 and 4 and q is an integer ranging between 1 and 4, the molar ratio C/D ranging between $$\frac{1}{q+1}$$

and q+1.

2. The composition as claimed in claim 1, characterized in that it consists of:

(a) 50% to 100% by weight of the combination containing from 20% to 80% by weight of an additive AB and from 80% to 20% by weight of an additive CD, and (b) 0% to 50% by weight of a combination of additives AD and CB obtained by reacting A and D in a molar ratio ranging between 0.2 and 4 and of B with C in a molar ratio ranging between 0.2 and 4.

3. The composition as claimed in claim 1, characterized in that it is obtained by combination of 50% to 80% of an additive AB and 20% to 50% by weight of an additive CD.

4. The composition as claimed in claim 1, characterized in that it comprises from 50% to 80% by weight of a combination of the additives AB and CD in an AB/CD molar ratio ranging from 0.2 to 4, and from 20% to 50% by weight of a combination AD and CB in an AD/CB molar ratio ranging from 0.2 to 4, where AD is the reaction product of A with D and CB is the reaction product of C and B where A, B, C and D are as defined in claim 1.

5. The composition as claimed in claim 1, characterized in that the carboxylic compound (A) is selected from the group consisting of dodecylmaleic anhydride, dodecenylmaleic anhydride, hexadecylmaleic anhydride, hexadecenylmaleic anhydride, octadecylmaleic anhydride, octadecenylmaleic anhydride, eicosylmaleic anhydride and eicosenylmaleic anhydride.

6. The composition as claimed in claim 1, characterized in that the polyalkyleneamine (B) is selected from the group consisting of diethylenetriamine, dipropylenetriamine, triethylenetetramine, tetraethylenepentamine and tetrapropylenepentamine.

7. The composition as claimed in claim 1, characterized in that the copolymer (C) comprises:

(a) from 45 mol % to 65 mol % of at least one carboxylic acid unit selected from the group consisting of acrylic acid and methacrylic acid, and (b) from 55 mol % to 35 mol % of at least one alkyl ester unit selected from the group consisting of an acrylic ester and an methacrylic ester.

8. The composition as claimed in claim 7, characterized in that the copolymer (C) is selected from the group consisting of acrylic acid/methacrylic ester copolymer and methacrylic acid/acrylic ester copolymer containing 45 mol % to 65 mol % of carboxylic acid units and from 55 mol % to 35 mol % of ester units.

9. The composition as claimed in claim 1, characterized in that the N-alkylpolyalkylenepolyamine (D) is a compound selected from the group consisting of N-alkylethylenediamine, N-alkylpropylenediamine, N-alkylbutylenediamine, N-alkyldiethylenetriamine, N-alkyldipropylenetriamine, N-alkyldibutylenetriamine, N-alkyltriethylenetetramine, N-alkyltripropylenetetramine and N-alkyltributylenetetramine, with an alkyl radical containing from 12 to 22 carbon atoms.

10. The composition as claimed in claim 9, characterized in that the N-alkylpolyalkylenepolyamine D is selected from the group consisting of N-dodecyldipropylenetriamine, N-octadecyldipropylenetriamine, N-octadecyldiethylenetriamine and N-docosyldiethylenetriamine.

11. A fuel containing a majority of middle distillate, optionally containing a filterability additive, and a minority of a multifunctional additive composition as claimed in claim 1.

12. A fuel containing a majority of middle distillate, optionally containing a filterability additive, and a minority of a multifunctional additive composition as claimed in claim 3.

13. A fuel containing a majority of middle distillate, optionally containing a filterability additive, and a minority of a multifunctional additive composition as claimed in claim 4.

14. A fuel containing a majority of middle distillate, optionally containing a filterability additive, and a minority of a multifunctional additive composition as claimed in claim 2.

15. A multifunctional additive composition for the cold operability of middle distillates resulting from the reaction of carboxylic compounds with amine compounds, wherein the additive composition comprises at least 50% by weight of a mixture consisting of:

a) 10% to 90% by weight of an additive (AB) which is the reaction product of at least one carboxylic compound (A) selected from the group consisting of alkylmaleic and alkenylmaleic anhydrides and alkylsuccinic and alkenylsuccinic anhydrides containing from 4 to 32 carbon atoms in the alkyl and alkenyl radicals, the corresponding acids and esters with at least one polyalkylamine compound (B) of the formula (I):

$$NH_2—[(CH_2)_n—NH—]_m—H \quad (I)$$

wherein n is an integer ranging from 2 to 4, and m is an integer ranging from 1 to 4, the molar ratio A/B being between 1 and 2; and b) and 90% to 10% by weight of an additive (CD) which is the reaction product of:

i) at least one copolymer (C) resulting from the reaction of at least one first unsaturated carboxylic acid which may be unsubstituted or substituted with at least one alkyl ester of at least one second substituted or unsubstituted unsaturated carboxylic acid, which may be identical to or different from the first, of the formula (II):

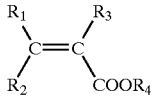

(II)

wherein each of $R_1$ and $R_2$ is independently selected from the group consisting of hydrogen and linear or branched alkyl group containing from 1 to 20 carbon atoms, $R_3$ is hydrogen or a linear alkyl group of not more than 3 carbon atoms, and $R_4$ is hydrogen or an alkyl group containing from 1 to 25 carbon atoms;

ii) with an N-alkylpolyalkylenepolyamine (D) of the formula (III):

$$R_5—NH—[—(CH_2)_p—NH—]_q—H \quad (III)$$

wherein $R_5$ is a saturated aliphatic radical comprising from 12 to 22 carbon atoms, p is an integer from 2 to 4, and q is an integer ranging from 1 to 4, wherein the molar ratio C/D ranges from 1 to 2.

16. The composition as claimed in claim 15, wherein the composition comprises:

50% to 100% by weight of a mixture containing from 20% to 80% by weight of an additive AB and from 80% to 20% by weight of an additive CD, and 0% to 50% by weight of a mixture of additives AD and CB obtained by reacting A and D in a molar ratio ranging from 0.2 to 4 and of B with C in a molar ratio ranging from 0.2 to 4.

17. The composition as claimed in claim 15, wherein the composition comprises a mixture of 50% to 80% of the additive AB and 20% to 50% by weight of the additive CD.

18. The composition as claimed in claim 15, wherein the composition comprises from 50% to 80% by weight of a mixture of AB and CD in an AB/CD molar ratio ranging from 0.2 to 4, and from 20% to 50% by weight of a mixture of AD and CB in an AD/CB molar ratio ranging from 0.2 to 4, where AD is the reaction product of A with D and CB is the reaction product of C and B where A, B, C and D are as defined in claim 15.

19. The composition as claimed in claim 15, wherein the carboxylic compound (A) is selected from the group consisting of dodecylmaleic anhydride, dodecenylmaleic anhydride, hexadecylmaleic anhydride, hexadecenylmaleic anhydride, octadecylmaleic anhydride, octadecenylmaleic anhydride, eicosylmaleic anhydride and eicosenylmaleic anhydride.

20. The composition as claimed in claim 15, wherein the polyalkyleneamine (B) is selected from the group consisting of diethylenetriamine, dipropylenetriamine, triethylenetetramine, tetraethylenepentamine and tetrapropylenepentamine.

21. The composition as claimed in claim 15, wherein the copolymer (C) is comprises:

(a) from 45 mol % to 65 mol % of at least one carboxylic acid unit selected from the group consisting of acrylic acid and methacrylic acid, and (b) from 55 mol % to 35 mol % of at least one alkyl ester unit, selected from the group consisting of an acrylic ester and an methacrylic ester.

22. The composition as claimed in claim 15, wherein the copolymer (C) is selected from the group consisting of an acrylic acid/methacrylic ester copolymer and a methacrylic acid/acrylic ester copolymer, wherein the copolymer (C) comprises 45 mol % to 65 mol % of carboxylic acid units and from 55 mol % to 35 mol % of ester units.

23. The composition as claimed in claim 15, wherein the N-alkylpolyalkylenepolyamine (D) is selected from the group consisting of N-alkylethylenediamine, N-alkylpropylenediamine, N-alkylbutylenediamine, N-alkyldiethylenetriamine, N-alkyldipropylenetriamine, N-alkyldibutylenetriamine, N-alkyltriethylenetetramine, N-alkyltripropylenetetramine and N-alkyltributylenetetramine, wherein the alkyl radical comprises from 12 to 22 carbon atoms.

24. The composition as claimed in claim 15, wherein the N-alkylpolyalkylenepolyamine D is selected from the group consisting of N-dodecyldipropylenetriamine, N-octadecyldipropylenetriamine, N-octadecyldiethylenetriamine and N-docosyldiethylenetriamine.

25. A fuel containing a majority of middle distillate, optionally containing a filterability additive, and from 50 to 1,000 ppm of a multifunctional additive composition as claimed in claim 15.

26. A fuel containing a majority of middle distillate, optionally containing a filterability additive, and from 50 to 1,000 ppm of a multifunctional additive composition as claimed in claim 16.

27. A fuel containing a majority of middle distillate, optionally containing a filterability additive, and from 50 to 1,000 ppm of a multifunctional additive composition as claimed in claim 17.

28. A fuel containing a majority of middle distillate, optionally containing a filterability additive, and from 50 to 1,000 ppm of a multifunctional additive composition as claimed in claim 18.

* * * * *